United States Patent [19]

Durand-Texte

[11] Patent Number: 4,528,836

[45] Date of Patent: Jul. 16, 1985

[54] PROCESS FOR CHANGING THE CROSS-SECTION OF A BAND OF MALLEABLE MATERIAL SUCH AS COPPER

[76] Inventor: Gerard Durand-Texte, 14, rue de l'Odéon, Paris, France

[21] Appl. No.: 635,486

[22] Filed: Jul. 31, 1984

Related U.S. Application Data

[63] Continuation of Ser. No. 437,262, Oct. 28, 1982, abandoned.

[30] Foreign Application Priority Data

Oct. 30, 1981 [FR] France ..... 81 20463

[51] Int. Cl.[3] ..... B21J 5/12

[52] U.S. Cl. ..... 72/376; 72/377; 72/412

[58] Field of Search ..... 72/366, 377, 376, 375, 72/412, 414, 416, 476, 479

[56] References Cited

U.S. PATENT DOCUMENTS

| | | | |
|---|---|---|---|
| 2,371,671 | 3/1945 | Blount et al. | 72/366 |
| 3,792,602 | 2/1974 | Fukuda | 72/220 |
| 4,407,056 | 10/1983 | Watanabe et al. | 72/403 |

FOREIGN PATENT DOCUMENTS

| | | | |
|---|---|---|---|
| 505447 | 3/1976 | U.S.S.R. | 72/366 |

*Primary Examiner*—Lowell A. Larson
*Attorney, Agent, or Firm*—Louis Orenbuch

[57] ABSTRACT

This invention concerns a process for transforming the cross-section of a band with parts or reduced thickness without removal of material characterized in that a relative drawing movement of the band in relation to the tool is created over each transverse zone (Zi) in the drawing direction (F) of the band (10), a sucession of elemental compressions is carried out of which each concerns only a fraction of the width of the part the thickness of which is to be reduced, the part of reduced thickness is progressively widened by compressing the adjacent part once again to the initial thickness.

9 Claims, 14 Drawing Figures

Z1
A
A
d
F
LA
10
H
11
12
B
B
d
LB
lb
3B
13
13c
14
C
C
d
LC
lc
3C
15
16
D
D
d
ld
3D

PROCESS FOR CHANGING THE CROSS-SECTION OF A BAND OF MALLEABLE MATERIAL SUCH AS COPPER

This application is a continuation of my earlier application Ser. No. 437,262, which was filed on Oct. 28, 1982 and now abandoned.

The invention concerns a process and an apparatus for transforming the cross-section of a band, especially of copper, in order to obtain a cross-section having parts of reduced thickness, without machining to remove material.

In various fields, it is necessary to work on bands, especially copper bands.

This transformation cannot be carried out by rolling, because rolling involves elongation of the corresponding part of the band along the axis of the band, which is impermissible when the non-rolled parts cannot or should not be elongated.

The generally adopted solution in order to form such bands with one or more parts of reduced thickness, consists in starting with a copper band of substantially rectangular cross-section, and machining to remove material from the parts to be reduced in thickness. This procedure involves a substantial amount of work and results in a considerable amount of waste material which, if possible, must be re-cycled.

The present invention has for its object the provision of a process and an apparatus which permits the transformation of a cross-section of a band in order to obtain zones of reduced thickness by a transformation operation, that is to say without removal of shavings, by starting with a long band, which may possibly be longitudinally cut to the necessary length.

For this purpose, the invention concerns a process characterised by advancing the band lengthwise relative to a hammering tool and performing a succession of elemental compression steps on the band in a hammering zone that extends along and transversely to the direction of advance of the band, each elemental compression step involving only a fraction of the width of the part whose thickness is to be reduced and each succeeding compression step progressively enlarging the part of reduced thickness by compressing the parts of original thickness which are adjacent to the section of reduced thickness in a manner causing the displaced material to be displaced laterally relative to the lengthwise direction of the band whereby the cross-section of the band is transformed progressively from its initial cross-section to its final cross-section as the band progresses through the hammering zone.

Thanks to this procedure of employing successive elemental compressions, displacement of the material is restrained in the longitudinal direction and cannot cause a local elongation of the band, but only a widening of it. Because compression is not performed simultaneously over the whole width of the part whose thickness is to be reduced, but only over a fraction of the latter, and occurs in a progressive manner between the point where the section has its initial form and the point where the section has its final form, the transverse displacement of the material takes place without inducing in the band any constraint which can cause local deformation of the band, undulations etc.

Further, although, in general, the process envisaged concerns the reduction of the thickness of a part of a band, the process can be repeated in order to form as many identical or different parts of reduced thickness (in terms of thickness and width) as necessary, by starting with bands having initial cross-sections which are very varied and not necessarily rectangular.

The choice of the various parameters for carrying out the process, such as the parameters of the tools (width, length), of the force used, depends on the material to be machined and the cross-sectional form to be produced.

According to another characteristic, in the hammering zone, the hammering tool is arranged so that the marks of the elemental compressions formed by the hammering tool corresponds overall to the form of an inverted V, the point of which is directed upstream, in the direction of drawing.

This V arrangement can be more or less open and one of the branches of this V shape can even be absent or arranged parallel to the drawing axis.

According to another characteristic, the length of movement of the band when this is advanced continuously or between each elementary compression in the case of a stepwise movement, is less than the length of the elemental compression surface of the tools, this length being considered in the drawing direction.

The invention also concerns apparatus for carrying out the process.

Such apparatus is characterized in that it includes means for stepwise drawing of the band, and tools in the form of punches, and especially rigid tools having a working surface in the from of a V.

In general terms, the process and apparatus according to the invention offer the advantage of permitting the formation of a band cross-section which cannot be obtained otherwise except by machining with removal of shavings.

The means for carrying out the invention are relatively simple and of little complexity. The yield of the process and the shapes of the cross-sections obtained are excellent.

One process and one apparatus according to the invention will be described, by way of example, with the aid of the various drawings attached, in which:

FIGS. 1, 2, and 3 show various cross-sections of copper bands formed at present by machining with removal of shavings, and which can be formed with the aid of the process according to the invention;

Figure 1:
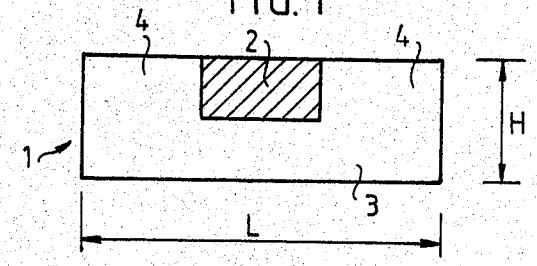

FIG. 1 is a cross-sectional view of a copper band 1 which, initially, has a rectangular cross-section of width L and height H; after machining to remove shavings at the portion 2, there remains the part 3 of reduced thickness bordered by parts 4 which remain at the initial thickness H.

Figure 2:
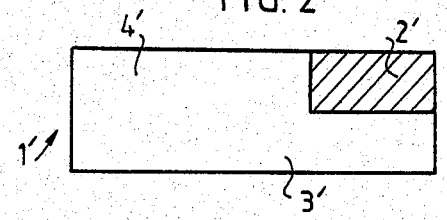

FIG. 2 shows another section of copper band 1', which is also capable of being formed by machining with removal of shavings. In the case of this section, the portion 2' is removed to allow the portion 3' of reduced thickness to remain and the portion 4', the thickness of which corresponds to the initial thickness H.

Figure 3:
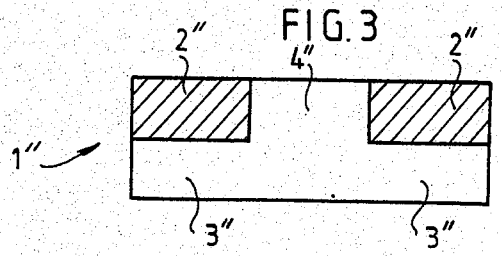

FIG. 3 shows a third variant of a section of copper band 1", which can be formed by machining with removal of shaving of the portion 2" which border on a central portion 4" which remains at the initial height; the removal of the two lateral portions allows the portion 3" of reduced thickness to remain.

Figure 4:
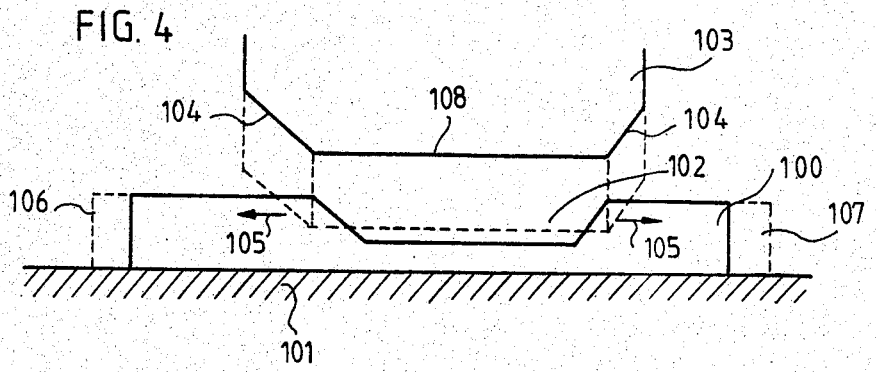
FIG. 4 is a transverse section of a band during the course of transformation.
Figure 5:
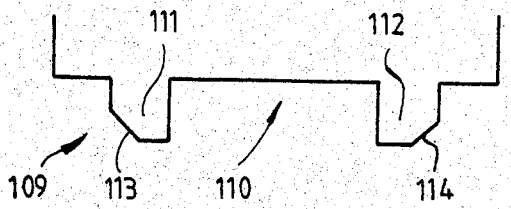
FIG. 5 is a simplified section of a first embodiment of tool.
Figure 6:
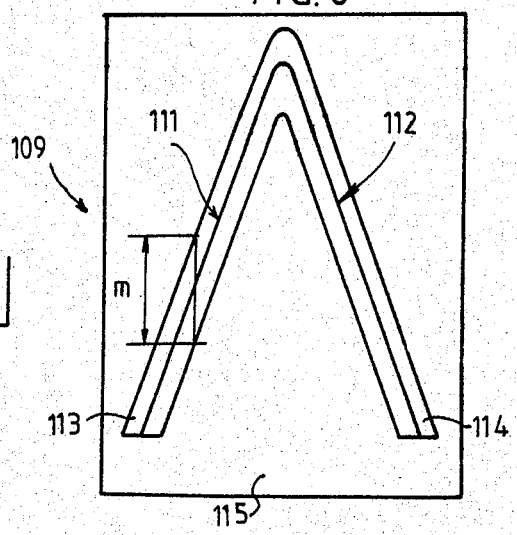
FIG. 6 is a bottom view of the tool according to FIG. 5.

The process according to the invention will be first described with the aid of FIGS. 4 to 7 of which FIG. 4 corresponds to the description of the deformation of a band segment under the effect of a tool, the necessary deformation being performed, for example, with the aid of a V-shaped tool such as that shown in FIGS. 4, 5 and 6.

The step-by-step description of the various operations and of the action of the various tools or tool portions will be given with the aid of FIGS. 8A–8D and 9.

FIG. 4 is a vertical cross-section of a tool for carrying out the process of the invention.

Starting with a band 100 resting on a support 101 and already having been subjected to deformation (cavity 102), there is used a tool 103 in the form of a punch of which the lower lateral edges 104 are oblique so as to displace material towards the outside in the transverse direction (arrows 105). This tool 103 leaves an indentation in the band 100. The outline of this indentation is shown in broken lines; the material thus displaced causes a widening of the band 100 (see the edges 106, 107 shown in phantom).

From FIG. 4 it can be appreciated that the effective zone of action of the tool 103 is located along the sloping edges 104, the bottom 108 of the tool practically not participating in displacing material towards the sides. It is therefore advantageous to use a tool 109 having a cross-sectional form such as that given in FIG. 5. In this tool, the bottom 108 (FIG. 4) has been replaced by a cavity 110 bordered by two portions 111, 112 having sloping edges 113, 114. Pressing of the bottom of the tool on the bottom of the cavity is thus avoided, which in most cases is harmful.

FIG. 6 is a plan view of the mark of the tool 109 of generally V-shaped form (as will be explained with the aid of FIGS. 8A–8D and 9), the two branches 111, 112 being connected into a single piece.

Figure 7:
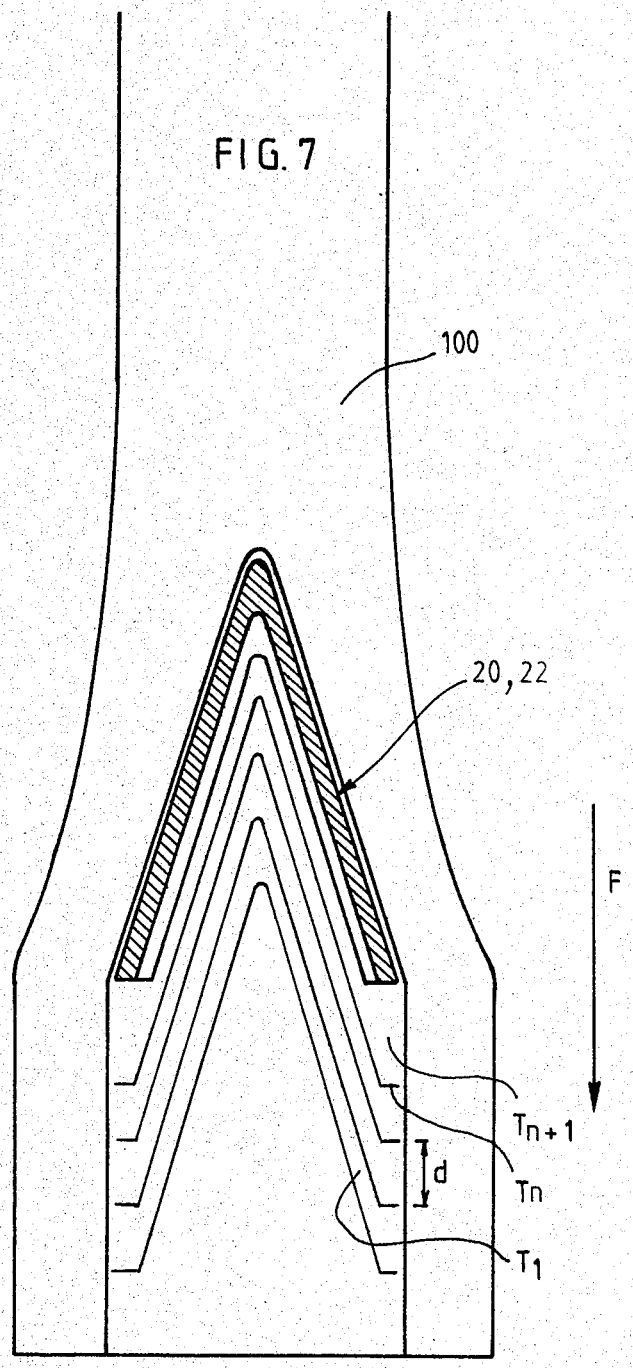
FIG. 7 is a top plan view of a band during the course of transformation.

FIG. 6 shows an embodiment of a one-piece tool and FIG. 7 shows the various stages of deformation of a band brought about with the aid of the tool according to FIG. 6.

The plan view of FIG. 6 shows the form of the tool 109 which is constituted by a support 115 and by a portion in relief 111, 112 which corresponds to the working portion of the tool which causes the compression and displacement of the material.

The tests made within the scope of the invention have in effect shown that it is particularly advantageous to use, in the case of copper, not complete tools 108, of which the working surface corresponds to a triangular or trapezoidal form, but that it is preferable to limit the useful shape of the tool to the part in relief 111, 112. The width m of the useful surface of the projecting part 111, 112 of the tool depends on the material which it is desired to transform.

FIG. 7 shows the position of the tool and the projecting portion 111, 112 in relation to the band 100 which is advanced stepwise in the direction of the arrow F. An indentation mark T1, T2, Tn, Tn+1, etc. corresponds to each advance of the tool. These marks are preferably narrower than the thickness m of the tool, in order to obtain a regular deformation.

In general, the width m of the tool 111, 112, should not be measured in the transverse direction but in the longitudinal direction, that is to say in the direction of advance F. In this case, the step d selected for the advance of the band 100 at each operation should be less than the width m of the tool. These various parameters are selected as a function of the material, of the power of the tool, etc.

In the above examples, the tool executes reciprocating striking movement controlled for example by a jack or press.

The operation of the process according to the invention will be described, in a schematic manner, with the aid of FIGS. 8A to 8D which correspond to various stages, which have been greatly simplified, of the manufacture of a copper band of which the cross-section corresponds to that of FIG. 1 but which, within the scope of the invention, is formed by machining without removal of shavings.

The beginning of the operation of deforming the band being a transistory phase, the description of the process will concern a normal deformation operation; for this, the deformation operation will be notionally cut into several corresponding phases, also notionally, at the putting into operation of a respective tool. These various phases are shown in the juxtaposed FIGS. 8A, 8B, 8C, 8D and which show the evolution of the form of an identical zone Zi of elemental length of the band, each time advanced by one step in the direction of advance of the band relative to the tool or respective tools.

So as not to complicate the drawings, the tools have by convention been shown in the form of punches without having been cut on the bias. It is however clear that in most cases and especially for working metallic ribbons, such biassed edges (see FIGS. 4, 5) are advantageous to displace the material in the transverse direction.

The direction of advance of the copper band is indicated by the arrow F.

To simplify the explanation and so as not to increase the number of references, in each figure, the references 8A, 8B, 8C, 8D show a plan view in the upper part and a sectional view in the lower part.

Figures 8A, 8B, 8C, 8D:
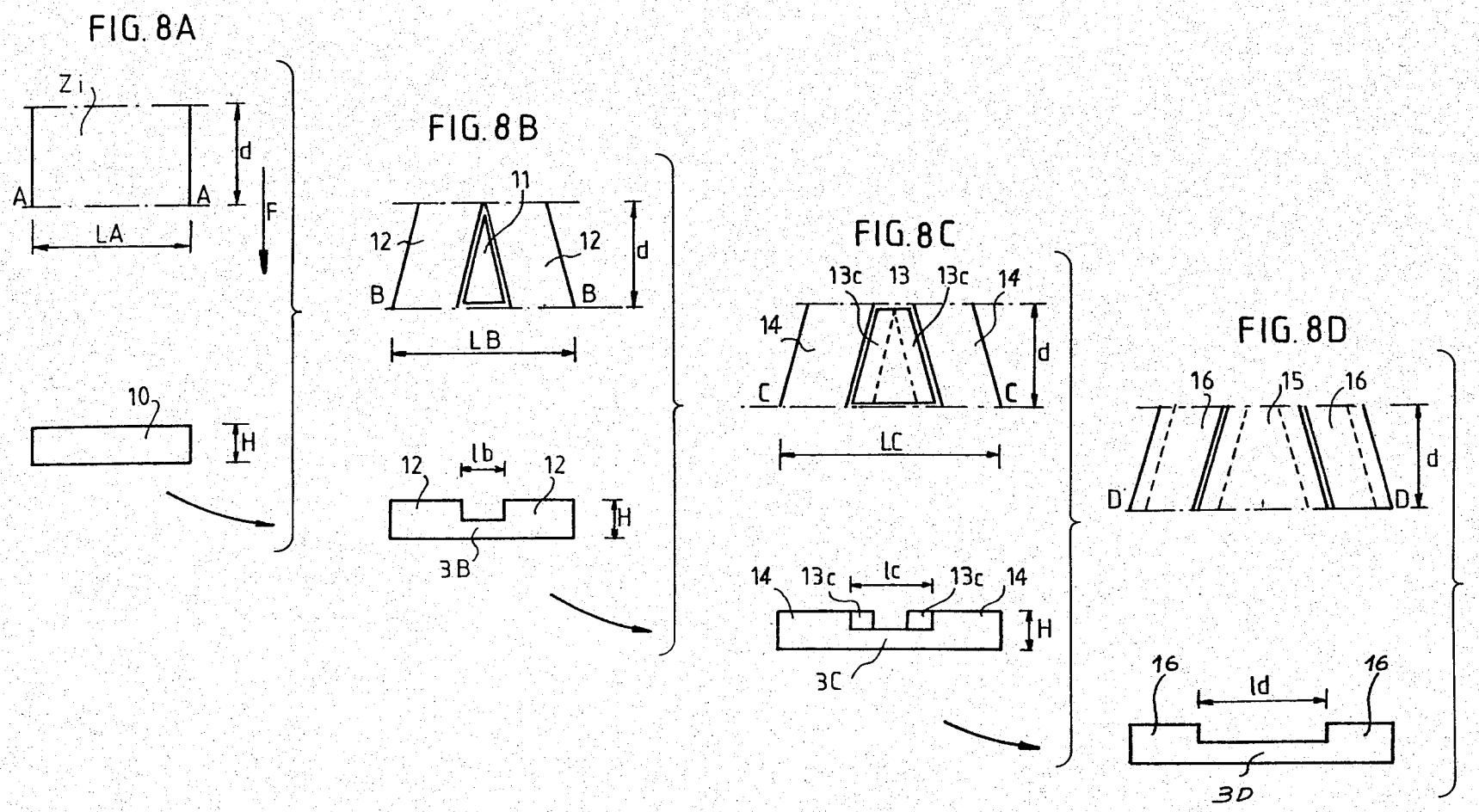
FIGS. 8A to 8D show schematically various stages of the manufacturing process of a copper band according to the invention, with a cross-section corresponding to that given in FIG. 1.

The sectional view has respectively been produced according to the plane of the cut A—A for FIG. 8A, according to the plane of the section B—B for FIG. 8B, according to the plane of section C—C for FIG. 8C and according to the plane D—D for FIG. 8D.

FIG. 8A shows the form of the copper band 10 upstream of the tool before transformation of its cross-section. The band has a rectangular cross-section of width LA and thickness H.

FIG. 8B shows the deformation of the band 10 after it has been advanced by one step or elementary length d, so as to come under a first tool 11; the latter (of substantially triangular shape) compresses the central portion of the band 10, to displace the material towards the sides and to leave two lateral bands 12; this operation results in compressing and spreading out the material of the central portion perpendicularly to the direction of displacement, in other words in the transverse direction.

The section FIG. 8B shows the lateral portions 12 which border the central part 3B of reduced cross-section.

The lateral portions 12 remain at the thickness H.

The central part of reduced thickness 3B has a width 1B.

FIG. 8C shows the result of the action of the tools after the band has been advanced again by a step d. In this figure the form of the band before carrying out of the operation corresponding to FIG. 8C has been shown in dashed lines; this dashed line drawing corresponds exactly to the drawing in full lines of FIG. 8B.

In the course of the deformation phase shown in FIG. 8C, the tool 11 acts on the portion of the band which has not yet been formed, as this has been shown in FIG. 8B when a second tool 13 is acting on the mark already made during the course of the stage 8B by the tool 11.

The sectional view of FIG. 8C shows the portions 13C which have been compressed by the tool 13 in order to arrive at the section shown. In this section, the reference 14 has been used to designate the new lateral parts of the thickness H, the width of which however is less than the thickness of the part 12 of FIG. 8B.

FIG. 8D represents a third operative phase corresponding to the preceding phases, and which is performed with the aid of a third tool 15. As in the preceding figures, FIG. 8D shows, in dots, the shape of the band resulting from phase 8C; the drawing in full lines shows the shape of the band after the action of the tool 15.

As above, the sectional view in the lower part of FIG. 8D shows the cross-section of the band. This is the final cross-section which it is desired to obtain.

Figure 9:
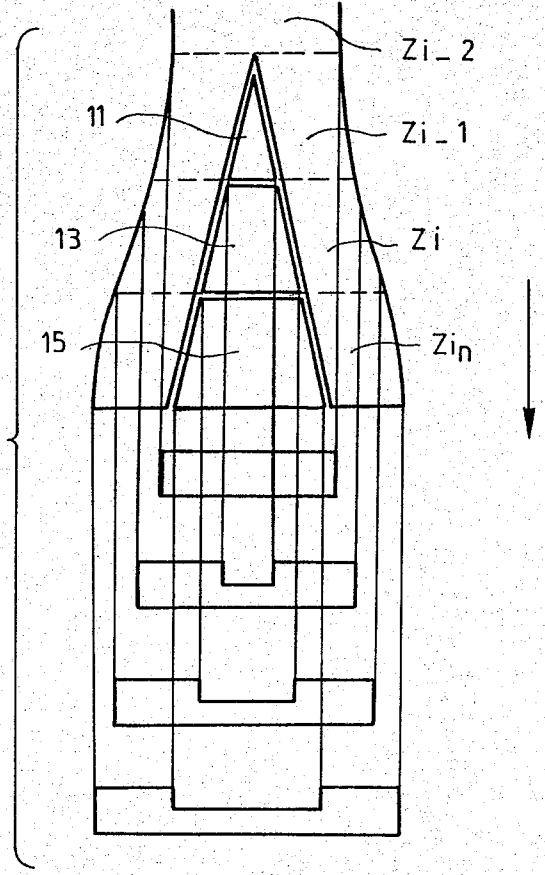
FIG. 9 is a summary of the stages of FIGS. 8A to 8D.

FIG. 9 is a summary or a rearrangement of FIGS. 8A to 8D showing the whole of the working zone.

In order to simplify the explanation of the process, this has been described as if applied only to the elemental zone Zi. Now, while one tool deforms the zone Zi, the tool directly downstream deforms the zone Zi+1, the following tool deforms the zone Zi+2, etc.

These tools act simultaneously or successively in a particular order, according to a cyclic movement. This characteristic of the process is important to prevent deformation from giving rise to an elemental elongation in the longitudinal direction and not the transverse direction.

In the above explanation, the tool 11, 13, 15, has from choice been divided into three parts each of them corresponding to the length of one step of advance of the band. Now, this is clearly not the case because the tool is in a single piece. On the contrary, when the tool comprises, for reasons of manufacture etc., several pieces 11, 13, 15, the length of these pieces is not necessarily related to the length of the step d, and need have no relationship with this length.

In general terms, each tool or part of the whole tool acts not only on a width of the band, which corresponds to a fraction of the width of the band, but above all on a fraction of the finally deformed width of the band. The tools or tool parts act necessarily on successive elemental lengths of the band.

These conditions constitute the basic conditions of the invention, because it is necessary that the deformations (elemental compressions of the thickness of the band) result in the displacement of material in the lateral direction of the band, and not in the longitudinal direction.

The choice of elemental deformations performed by a tool or a tool portion, at each step or elemental advance, depends on various parameters such as:

the nature of the material of the band,
thickness and width of the band,
the geometry of the deformation (thickness and width of the band),
power of the machine.

Figure 10:
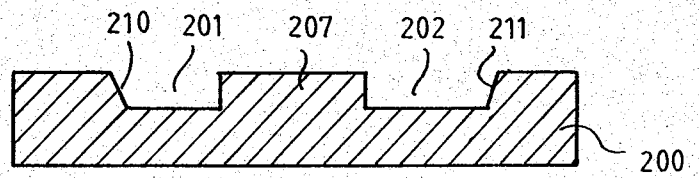
FIG. 10 is a cross-section of a band having two "grooves" formed according to the invention.
Figure 11:
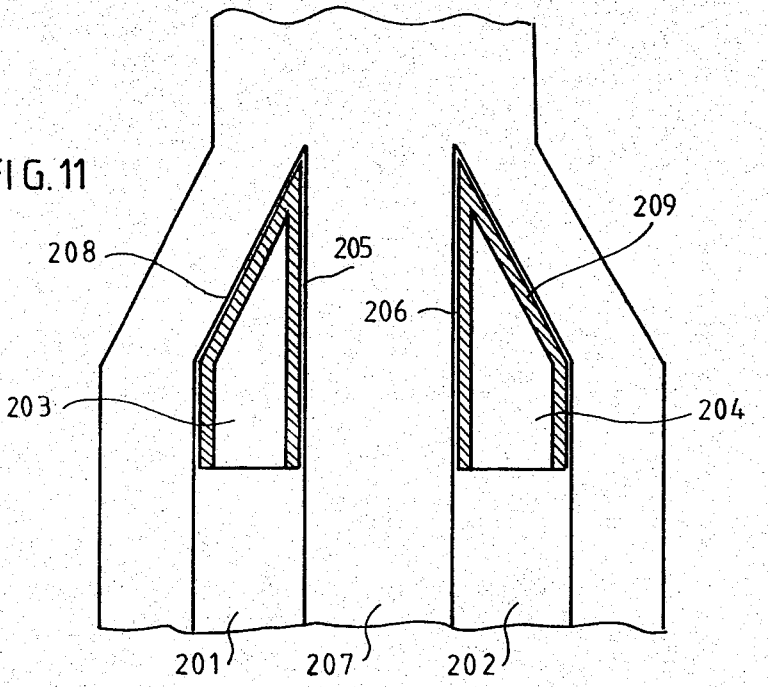
FIG. 11 is a schematic plan view of the manufacture of a shape according to FIG. 10.

In order to form a band cross-section 200 with grooves 201, 202 (FIGS. 10 and 11) a tool comprising two parts 203, 204 in the form of a V is used, of which the working surface is hatched.

The two branches 205, 206 which border the intermediate band 207, are parallel to the direction of displacement; this arrangement is necessary because the tools must not push back the material towards this band 207. On the contrary, the other branches 208, 209 are inclined and include a sloping edge (not seen in this figure), these edges leaving marks in the form of inclined surface 210,211.

Although the process according to the invention and the tools have been described above in the case of a transformation of the cross-section of a band of copper, other materials can equally well be transformed under the same conditions. In the same concept, although the process and the apparatus described above have been designed to transform a band of rectangular cross-section and a band of which the cross-section corresponds to FIG. 1, other transformations in the shape of cross-sections can be envisaged with the same process and analagous tools.

Equally, the form of the tool can be modified, for example, so as to form the sections of FIGS. 2 and 3.

Thus, to form the cross-section of FIG. 2, it can be arranged to orientate the tool differently so that one of the sides of the tool, which concerns tools 11, 13, 15 or tool 20, are parallel to the axis of displacement of the band. Such symmetrical tools can be used to form the cross-section according to FIG. 3.

I claim:

1. A cold metal working process for transforming the cross-section of a band, especially of copper to obtain a cross-section having a portion of reduced thickness, without machining to remove material, the process comprising the steps of (i) causing the band to intermittently advance lengthwise relative to a hammering tool between blows of that tool, the hammering tool having at least one protrusion formed by two ridges converging to an apex in the direction opposite to the direction of advance of the band, each of the ridges having an elongate flat crest whose width is small in relation to its length, (ii) causing the hammering tool to perform a succession of elemental hammered compressions of which each involves compression by said protrusion along a length of the band that is long compared to the fraction of the width of the band which is reduced in thickness, the fraction of width of the band reduced by each elemental hammered compression being a small fraction of the width of the part whose thickness is to be reduced, each elemental hammered compression causing progressive widening of the part of reduced thickness with the adjacent parts retaining their initial thickness, whereby the successive elemental compressions cause incremental displacement of material in the transverse direction of the band so that, in the zone worked by the hammering tool, the cross-section of the band evolves progressively in the direction of advance from the initial cross-section to the final cross-section.

2. The cold metal working process according to claim 1, characterized in that the impression made on the band by the protrusion of the hammering tool corresponds as a whole to an inverted V-shape whose point is directed upstream relative to the direction of advance.

3. The cold metal working process according to claim 1, characterized in that the length of advance of the band between each elemental compression is less than the length of the elemental compression surface of the hammering tool measured in the direction of advance of the band.

4. The cold metal working process according to claim 1 characterized in that the band is incrementally advanced in steps between blows of the hammering tool.

5. A cold metal working process for transforming the cross-section of a band of malleable material such as copper to obtain a cross-section having a portion of reduced thickness, comprising the steps of (i) causing the band to advance in its lengthwise direction relative to a hammering tool having at least one protrusion formed by two elongate ridges converging to an apex in the direction opposite to the direction of advance of the band, at least one of the two ridges having at least one of its elongate sides presenting a laterally sloping face, each of the two ridges having an elongate flat crest whose width is small in relation to its length, (ii) causing material in the portion to be reduced in thickness to be displaced in increments toward at least one side of the band with the adjacent portions retaining their initial thickness by successively striking the advancing band with the hammering tool along substantially the entire extent of the elongate flat crest of at least one of the two ridges whereby progressive widening of the reduced thickness portion occurs with concurrent progressive widening of the band.

6. The cold metal working process according to claim 5, wherein the band is advanced in steps between blows of the hammering tool, and the process further includes the step of (iii) regulating the extent of advance of each step to cause the amount of material displaced from the portion to be reduced in thickness by hammering after each stepped advance to be a fraction of the entire amount of material required to be displaced to attain the full cross-sectional extent of said portion of reduced thickness.

7. A cold metal working process for transforming the cross-section of a band of malleable material such as copper to obtain a cross-section having a portion of reduced thickness, comprising the steps of (i) causing the band to advance in its lengthwise direction relative to a hammering tool having at least one chevron-like protrusion formed by two elongate ridges converging to an apex in the direction opposite to the direction of advance of the band, each of the ridges having an elongate flat crest whose width is small in relation to its length, (ii) causing material in the portion to be reduced in thickness to be displaced in increments toward the sides of the band with the adjacent portions retaining their initial thickness by successively striking the advancing band with the hammering tool along substantially the entire extent of the flat crest of the elongate ridges whereby progressive widening of the reduced thickness portion occurs with concurrent progressive widening of the band.

8. The cold metal working process according to claim 7, wherein the band is advanced in steps between blows of the hammering tool, and the process further includes the step of (iii) regulating the extent of advance with each step to cause the amount of material displaced from the portion to be reduced in thickness by hammering after each stepped advance to be a fraction of the entire amount of material required to be displaced to attain the full cross-sectional extent of said portion of reduced thickness.

9. A cold metal working process for changing the cross-section of a band of malleable material such as copper to obtain a cross-section having a portion of reduced thickness, comprising the steps of (i) causing the band to advance in its lengthwise direction relative to a hammering tool having at least one protrusion formed by two elongate ridges converging to an apex in the direction opposite to the direction of advance of the band, each of those ridges having an elongate flat crest whose width is small in relation to its length, (ii) causing material in the portion to be reduced in thickness to be displaced in increments toward at least one side of the band with the adjacent portions retaining their initial thickness by successively striking the advancing band with the hammering tool along substantially the entire extent of the flat crest of at least one of the two ridges whereby progressive widening of the reduced thickness portion occurs with concurrent progressive widening of the band.

* * * * *

UNITED STATES PATENT OFFICE

CERTIFICATE OF CORRECTION

Patent No. 4,528,836 Dated July 16, 1985

Inventor(s) Gerard Durand-Texte

It is certified that error appears in the above-identified patent and that said Letters Patent are hereby corrected as shown below:

delete the entire Abstract and in its place substitute the following:

ABSTRACT

A cold metal working process gradually changes the cross-section of a copper band to a wider band having one or more sections of reduced thickness. A hammering tool having a chevron-like protrusion, formed by two convergent elongate ridges with long and narrow flat crests, performs a succession of elemental hammered compressions on the band. The metal band, between blows of the hammering tool, is advanced toward the wider part of the chevron-like protrusion and enables the reduced thickness section to be progressively widened by hammering, with the long flat crests of the two ridges, on narrow strips of the portions of the band adjacent to the reduced thickness section. The material displaced from the hammered indentation at each elemental compression of the narrow strip is displaced substantially laterally and results in a widening of the band without an appreciable increase in the initial thickness of the other portions of the band's cross-section.

Signed and Sealed this

*Fifteenth* Day of *October 1985*

[SEAL]

*Attest:*

DONALD J. QUIGG

*Attesting Officer*

*Commissioner of Patents and Trademarks—Designate*